US008220404B2

(12) United States Patent
Grenestedt

(10) Patent No.: US 8,220,404 B2
(45) Date of Patent: Jul. 17, 2012

(54) BOAT SUSPENSION

(75) Inventor: Joachim L. Grenestedt, Hellertown, PA (US)

(73) Assignee: Lehigh University, Bethlehem, PA (US)

( * ) Notice: Subject to any disclaimer, the term of this patent is extended or adjusted under 35 U.S.C. 154(b) by 171 days.

(21) Appl. No.: 12/435,939

(22) Filed: May 5, 2009

(65) Prior Publication Data

US 2010/0000454 A1 Jan. 7, 2010

Related U.S. Application Data

(60) Provisional application No. 61/050,409, filed on May 5, 2008.

(51) Int. Cl.
*B63B 1/14* (2006.01)

(52) U.S. Cl. ..... 114/61.15; 114/283; 114/284

(58) Field of Classification Search ..... 114/61.1, 114/61.15, 284, 275, 279, 280, 283, 288
See application file for complete search history.

(56) References Cited

U.S. PATENT DOCUMENTS

| | | | | |
|---|---|---|---|---|
| 3,265,026 | A * | 8/1966 | Hamilton | 114/61.19 |
| 3,981,259 | A * | 9/1976 | Harper, Jr. | 114/61.15 |
| 4,457,248 | A * | 7/1984 | Thurston | 114/61.11 |
| 4,716,847 | A * | 1/1988 | Wilson, Jr. | 114/61.15 |
| 5,687,669 | A * | 11/1997 | Engler | 440/12.52 |
| 7,743,720 | B1 * | 6/2010 | Salani | 114/61.1 |
| 2007/0151494 | A1 * | 7/2007 | Carnevali | 114/61.1 |

* cited by examiner

*Primary Examiner* — Lars A Olson
(74) *Attorney, Agent, or Firm* — Design IP

(57) ABSTRACT

Boats and suspensions are provided, wherein the boat includes at least one hull, and at least one sponson, the at least one hull and at least one sponson connected by a shock-absorbing suspension member. The suspension greatly reduces the accelerations of the main hull, such that the hull accelerations are generally substantially less than the accelerations of the sponsons at selected speeds.

20 Claims, 11 Drawing Sheets

BOAT SUSPENSION

FIELD

Boat suspensions are provided, including suspensions for sponsons, hulls, pontoons, and combinations thereof.

BACKGROUND

Known boat designs do not sufficiently insulate passengers and hull contents from shock and vibration. This is particularly true at high speeds and in rough waters, where the motion of the boat relative to the water (waves) results in significant forces translated to the hull, resulting in high accelerations and exaggerated vertical and horizontal movements of the hull, and thereby its passengers and contents. This undesired motion is particularly problematic in lightweight and high speed boats. Indeed, light, fast boats used by coast guard and special operations forces translate so much force, such as through high accelerations and decelerations in use that soldiers and mariners commonly incur back injuries, whether acute or chronic, from riding in such boats. Additionally, the turning and maneuvering of light fast boats can be hampered by rough seas and high speeds.

For all these reasons, there exists a continuing need for boat suspension systems that absorb, deflect, and otherwise mitigate undesirable hull motions, while increasing rider comfort, vessel stability, and maneuvering performance.

SUMMARY

Boats and suspensions are provided, wherein the boat includes at least one hull, and at least one sponson, the at least one hull and at least one sponson connected by a shock-absorbing suspension member. The suspension greatly reduces the accelerations of the main hull, such that the hull accelerations are generally substantially less than the accelerations of the sponsons at selected speeds. As used herein, "suspension" is defined such that it includes at least one shock absorbing member. The shock absorbing member is selected from any known shock absorbing element, including but not limited to springs and dampers. Further, the shock absorbing member may achieve its function by any method of installation and mounting whether rigid, flexible, fixed, or any combination thereof.

In one embodiment, the at least one sponson is mounted to at least one boom, the at least one boom mounted to the hull at a location selected from the group consisting of starboard, port, fore, or aft. In another embodiment, the at least one boom comprises at least two booms, and wherein only one sponson is connected to each of the at least two booms. In one embodiment, the suspension further includes a trailing arm suspension.

DETAILED DESCRIPTION

The boat suspension can be incorporated with hulls and sponsons in any number of embodiments. For example, the suspension can be used in connection with as few as one sponson and one boat hull. In another embodiment, the suspension can include one boat hull and more than one sponson, with the multiple sponsons arranged in any number of configurations, including but not limited to: inboard design with one or multiple sponsons underneath the hull or within openings in the hull; outrigger design with multiple sponsons connected to either the starboard or port side of the hull; at least one sponson connected to each of the port and starboard sides of the hull, whether at the front or at the rear, or any combination thereof. Additionally, the suspension can be combined with boats having multiple hulls, such as catamarans. Further, the suspension can be utilized in combination with hulls having other shock absorbing features, such as hulls having floating decks or other shock absorbing deck features, shock-absorbing seats for passengers, and with boats having fixed or floating motor mounts, rudders, and other hull, power, and performance features. The figures provided herein are exemplary, but not limiting, of the boat suspension, boat design, and other inventions described and claimed herein.

Figure 1:
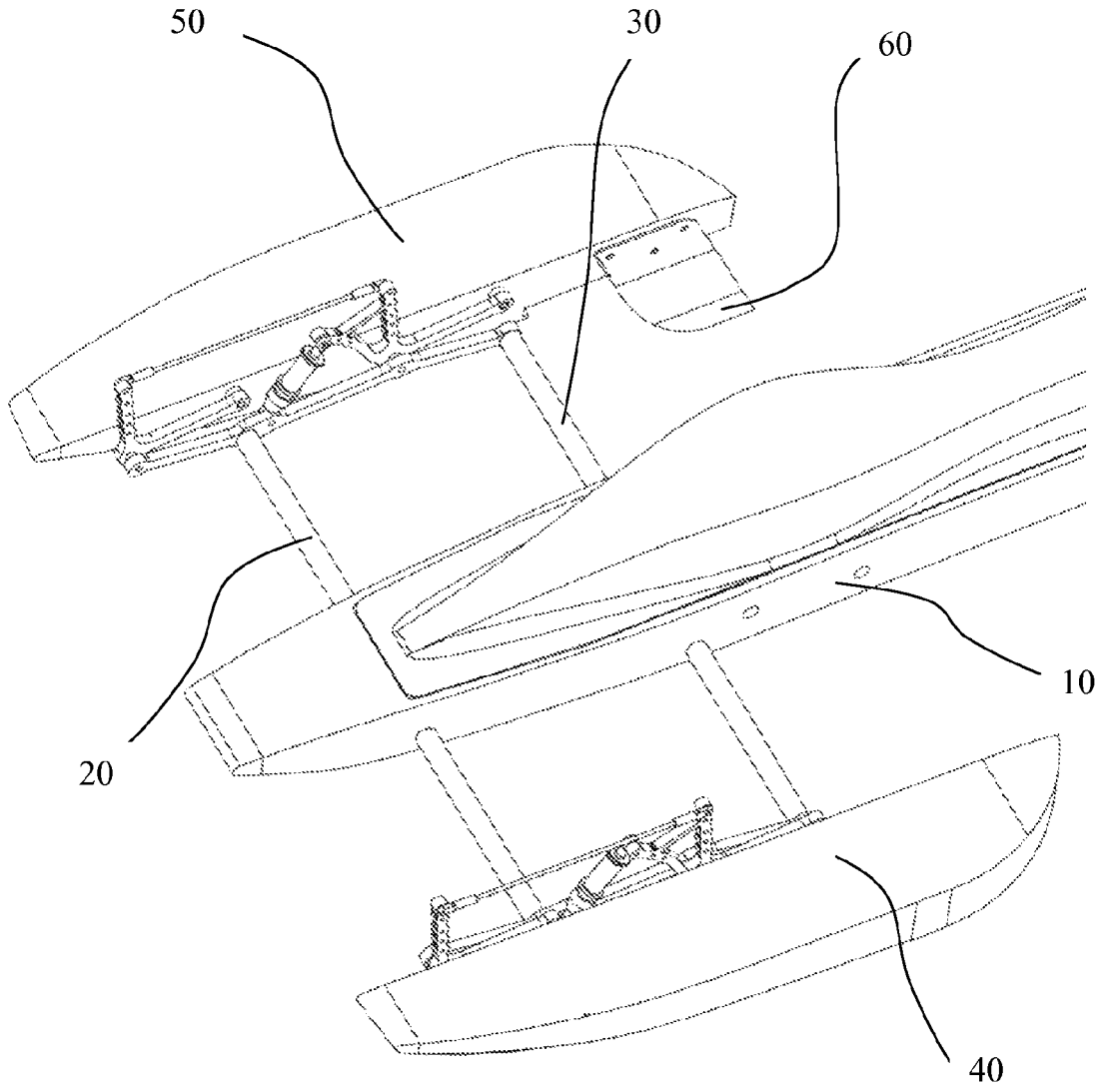
FIG. 1 is a top view of a boat having a hull linked to outboard sponsons by one embodiment of the boat suspension.
Figure 2:
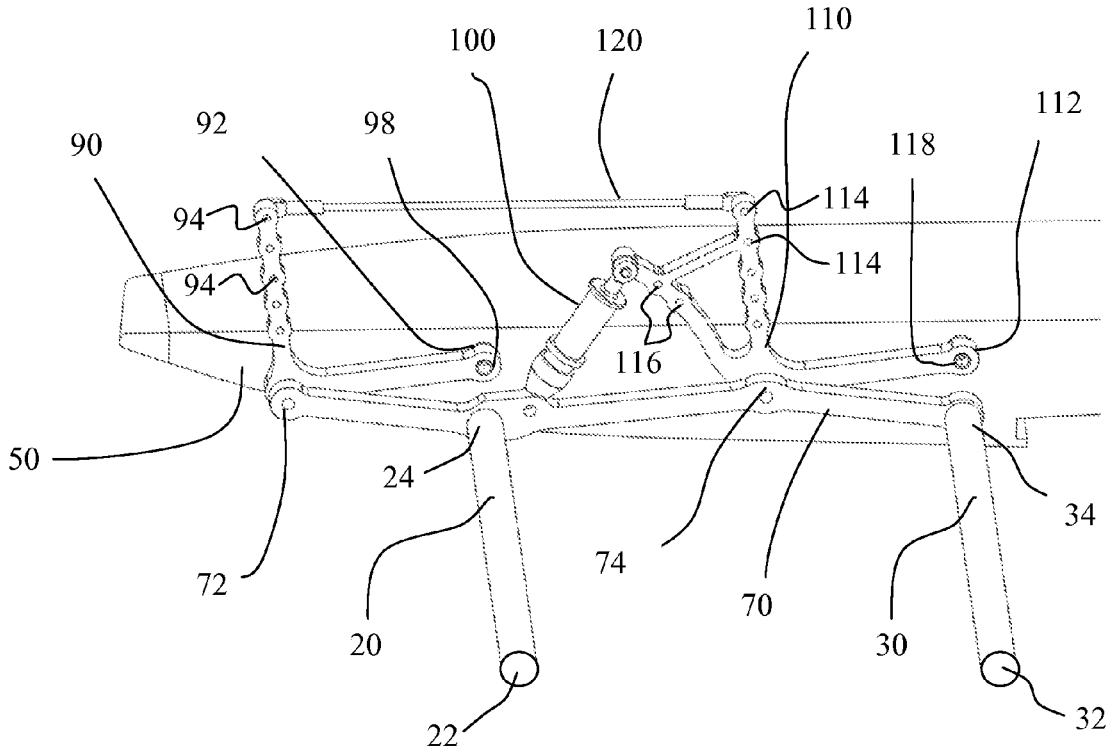
FIG. 2 is a side view of an embodiment of a rocker arm linked boat suspension.

In one embodiment, the boat is comprised of a main hull 10 with outboard starboard and port sponsons 50, 40 as seen in FIG. 1. The sponsons are supported by means of fore and aft support booms 20, 30 attached to a suspension. As further shown in FIG. 2, the support booms 20, 30 each have a first end 22, 32 that is fixedly attached to the hull 10, and an opposite, protruding end 24, 34 fixedly attached to the suspension link 70. The suspension link 70 is in turn pivotally attached to the fore and aft rocker arms 90, 110 by means of pivot attachments 72, 74, which may include bushings, bearings, or other pivot-enabling features. Additional inter-connective support of the rocker arms 90, 110 can be achieved by the attachment of a rocker arm link 120 to the rocker arms 90,110, which link may optionally be adjustable such as by providing multiple link holes in the rocker arms 90,110 at a desired hole location. The pivoting motion of both rocker arms 90, 110 is controlled by a spring and/or damping unit 100 which is attached (whether fixedly or rotatably) to aft rocker arm 110 and suspension link 70. Motion ratio, ride height, stiffness (spring rate) and damping for the suspension is adjusted by any of several methods, such as by relocating the upper end of the spring and/or damping unit 100 to a different mounting hole 116 provided on the aft rocker arm 110, or to a different hole in the suspension link 70, or by adjustments of the spring and/or damping unit. Finally, each rocker arm 90,110 is pivotally attached to the sponson 50, such as through fasteners inserted through the sponson attachment supports 92,112 provided on the rocker arms 90,110. As shown in FIG. 2, the fasteners may include bushings 98,118 to provide pivoting attachment that permits the suspension travel from the rocker arms 90, 110 to be transferred through to the sponson attachment supports 92, 112 located within the sponson 40,50, in this case a starboard sponson 50.

By way of non-limiting example, in each illustrated embodiment of the trailing arm suspension in FIGS. 1-2 and 4-6, two booms are used with two corresponding links to the suspension. The inventors fully contemplate that a single boom, as well as one with more than one contact point such as forked boom can be provided in other embodiments Therefore, a single boom, two booms, or any number of booms can be provided to link the hull to a sponson. In yet another embodiment, the deck of a boat can extend out from the hull such that the suspension can be mounted directly to the hull, or even underneath it.

Figure 3:
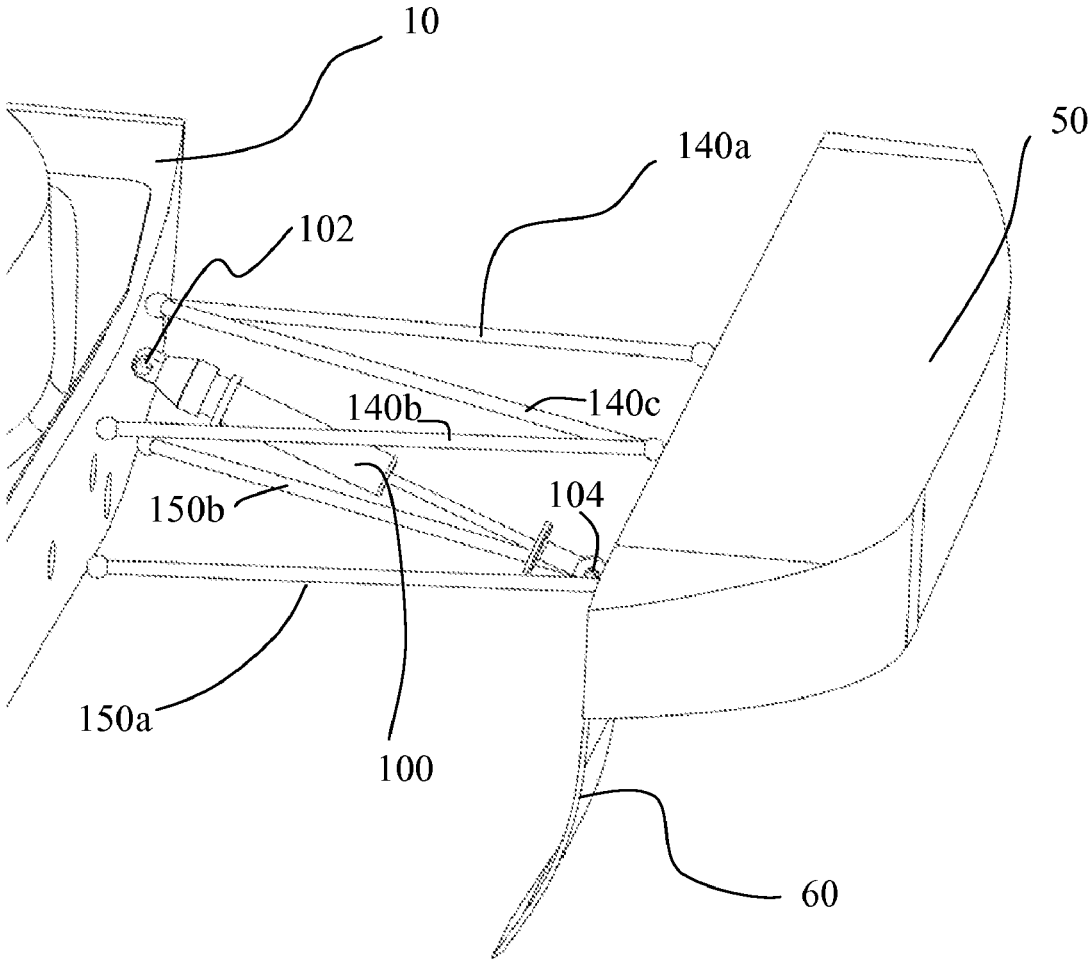
FIG. 3 is a rear view of an embodiment of a wishbone linked boat suspension.
Figure 9:
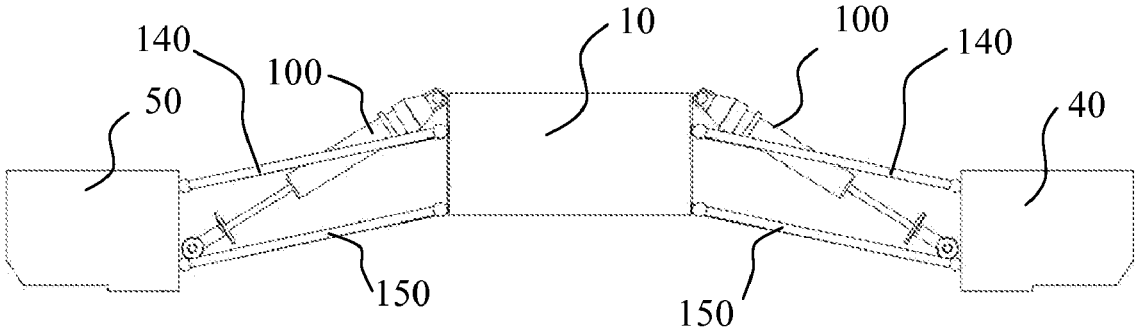
FIG. 9 is a schematic veiw of a boat suspension in another embodiment.
Figure 10:
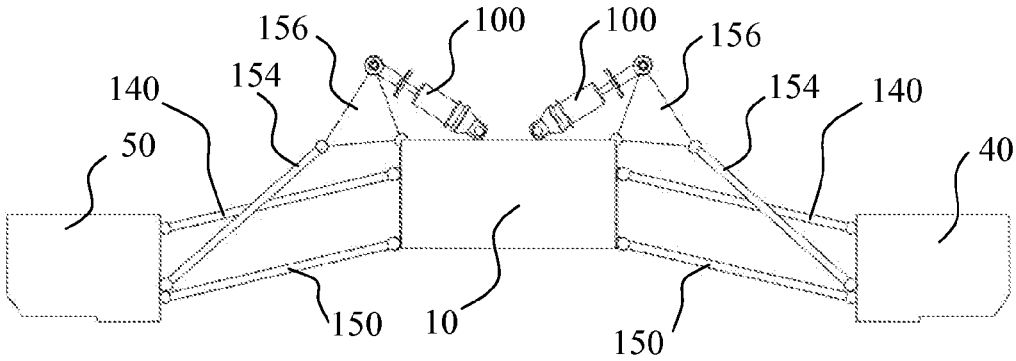
FIG. 10 is a schematic view of a boat suspension in another embodiment.
Figure 12:
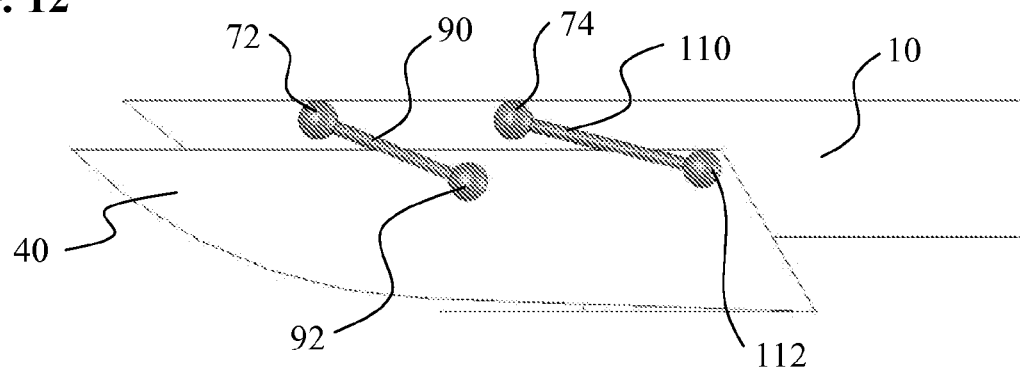
FIG. 12 is a schematic view of a boat suspension in another embodiment.

In an alternative suspension embodiment, as seen in FIG. 3, a double "wishbone" suspension design is provided. In this embodiment, the starboard sponson 50 is attached to the hull 10 through upper and lower wishbone suspension arms 140, 150. The lower wishbone suspension arms 150 are pivotally attached to the starboard side of the hull 10. In this case, a spring and/or damping unit 100 is utilized, which may be mounted outboard as in FIG. 3 (and also as shown in FIG. 9), or alternatively mounted inboard using bell cranks (also as shown in FIG. 10). In FIG. 3 the spring and/or damping unit 100 have a first end 102 pivotally or rotatably attached to the hull 10 and an opposite end 104 pivotally or rotatably attached to the sponson 50. For example, a first end of the spring and/or damping unit 100 may be mounted near the upper (adjacent the deck portion) of the hull 10. The upper wishbone suspension arms 140 (140*a*, 140*b*, 140*c*) are rotatably or pivotally attached to the starboard side of the hull 10. The attachment point of the upper 140 and lower 150 wishbones can be positioned such that the pitch, or angle of attack (angle between smooth water surface and bottom of sponson), changes during suspension motion. Further, roll and yaw angles can also be made to change with suspension motion. Forward/backward motion as well as sideways motion can also be attained. The way to accomplish these coupled motions could, for example, mirror those of racecar suspensions where non-parallel unequal length wishbones are commonly used. Relative heights of attachment points control dive, squat, anti-dive, anti-squat, etc in racecar; similar geometries can control pitch, roll, yaw angles as well as vertical and horizontal translations of sponsons in boat suspension. In FIG. 12 an embodiment with trailing arm suspension utilizing two non-parallel and unequal length trailing arms is shown. This embodiment is made such that the angle of attack is reduced when the sponson travels up (vertically) relative to the hull. In this embodiment the sponson also travels rearwards relative to the hull.

Figure 4:
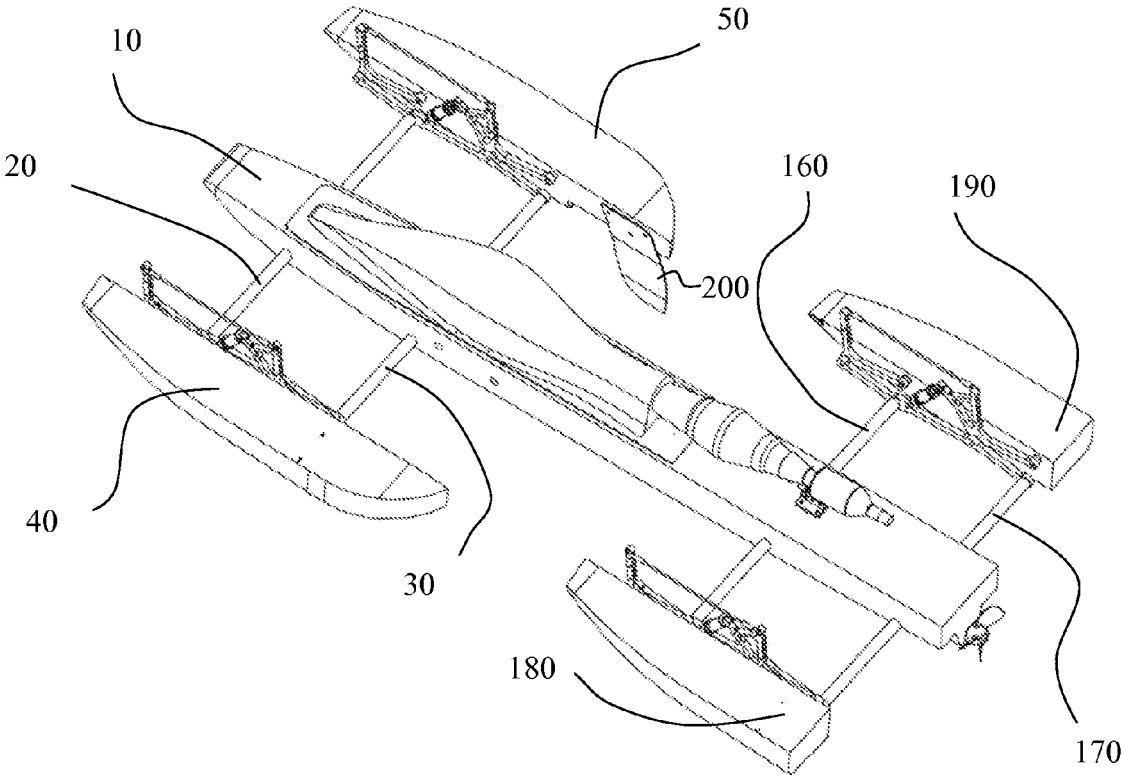
FIG. 4 is a top view of a boat hull linked to front and rear sponsons by an embodiment of the boat suspension.

In yet another embodiment, as shown ion FIG. 4, a fully suspended boat is provided having a main hull 10, two front suspended sponsons 40, 50, and two rear suspended sponsons 180, 190. In this embodiment, the front sponsons 40, 50 are suspended with the suspension substantially as depicted and described in FIG. 2, supported by the fore and aft support booms 20, 30. Further, the rear sponsons 180, 190 are suspended using the same suspension as in FIG. 2, but with support booms 160, 170 located at the rear of the hull 10.

Figure 7:
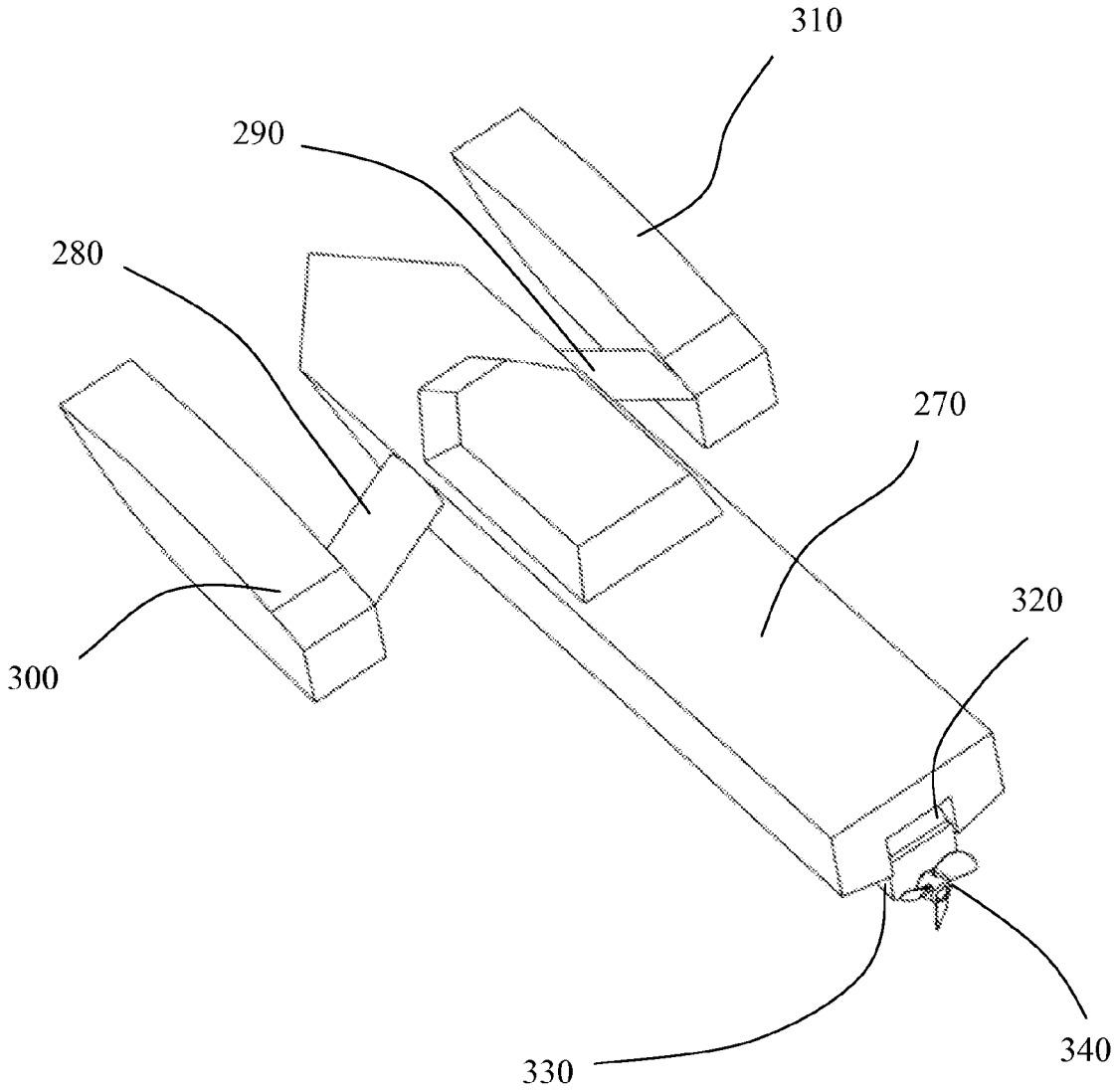
FIG. 7 is a top view of an embodiment of boat suspension including a full (front and rear) suspension.

In another embodiment, as shown in FIG. 7, two front sponsons 300, 310 are mounted via suspension to the main hull 270. In the rear a third sponson 320 is mounted via suspension to the main hull. The front sponsons may be suspended by pivotal motion of the booms 280, 290. The rear sponson may be suspended via rails or internal links, possibly of unequal length in order to control angle of attack change and forward/rearward motion coupled with suspension travel.

Figure 5:
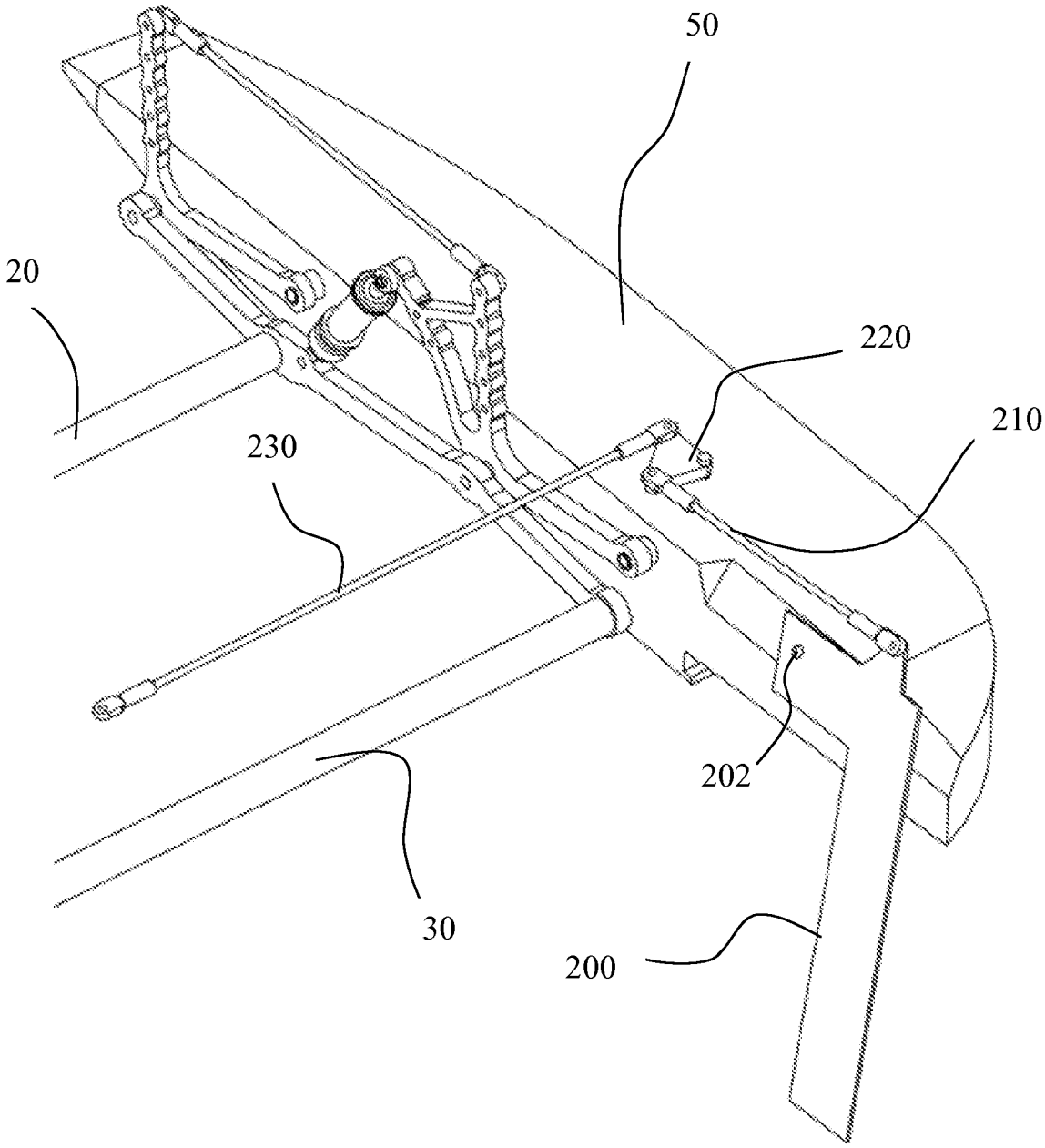
FIG. 5 is an isometric view of a starboard sponson that includes a substantially flat retractable turnfin.

FIG. 5 provides additional detail of the features of the boat of FIG. 4, with the starboard sponson 50 including a turnfin 200. The turnfin facilitates improved stability, as well as improved maneuverability. As further described herein, the turnfin 200 may be provided in a number of geometries, sizes and shapes to provide desired stability and/or straight-line or turning performance. Each turnfin 200 may be fixed or adjustable, whether manually or automatically, and may be retractable. Additionally, where a turnfin 200 is desirably adjustable and/or retractable, it can be manually or automatically adjustable, and preferably is automatically adjustable during vehicle motion, whether by servos, motors, or other known means for powered adjustment. Further, each turnfin 200 may be fully or partially or adjustably retractable, whether manually, automatically, directly, or by remote means.

In the embodiment of FIG. 5, a retractable flat turnfin 200 is attached to the starboard sponson 50 so that rotational movement of the turnfin 200 is allowed in the fore aft direction. This movement may be controlled by an inboard servo within the hull 10 via the turnfin link 210, turnfin bell crank 220, and the bell crank link 230. The turnfin bell crank 220 is attached to permit rotational movement around an attachment point for example on the top of the starboard sponson 50, which translates the movement from the bell crank link 230 to the turnfin link 210, which will raise and lower the retractable flat turnfin 200 to its desired position by pivot rotation, such as by pivot motion around a turnfin pivot 202 that pivotally connects the turnfin 200 to the sponson 50.

Figure 6:
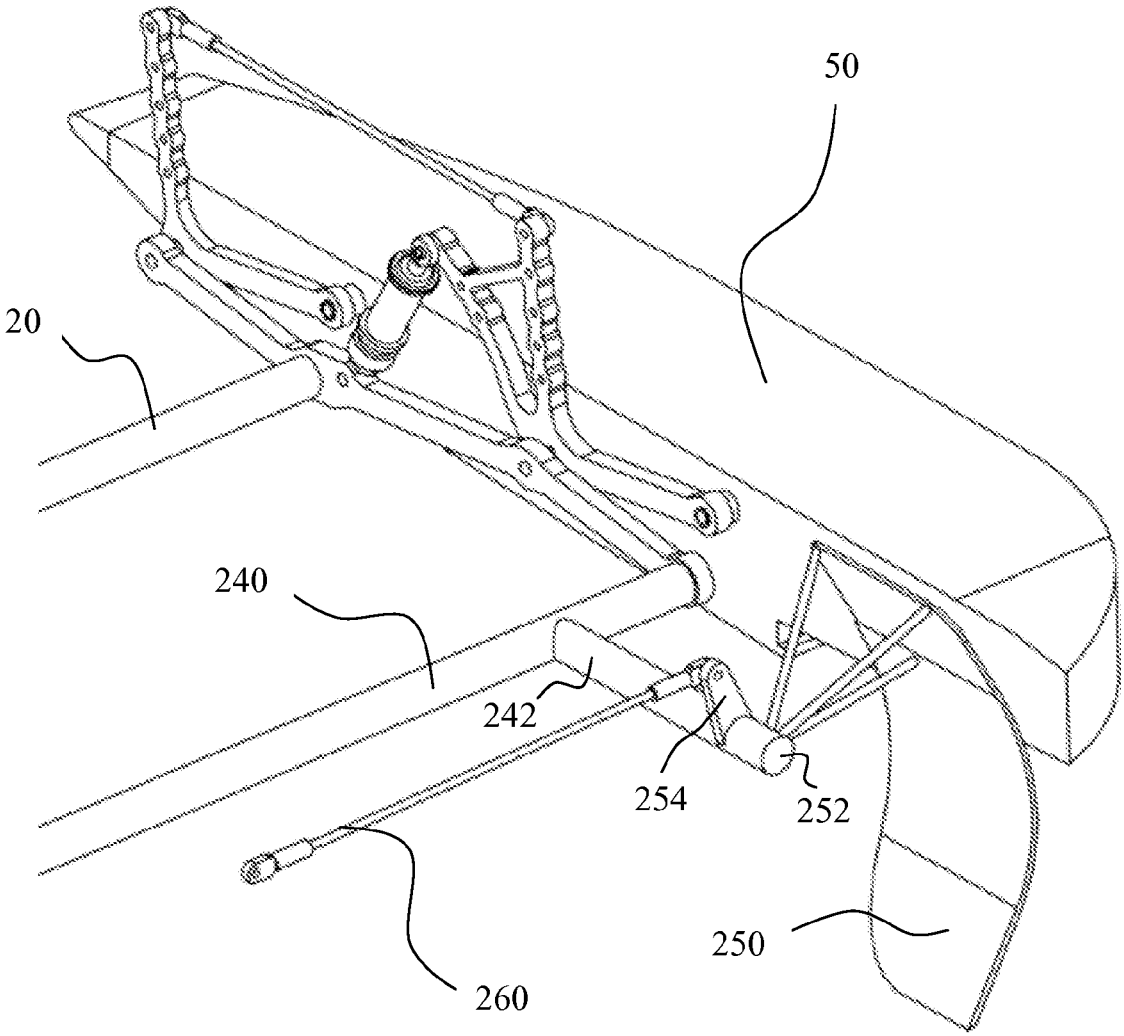
FIG. 6 is an isometric view of a starboard sponson that includes a curved retractable turnfin.

Another embodiment for providing and operating a retractable turnfin is depicted in FIG. 6. In this embodiment, the starboard sponson 50 is attached to the pre-described suspension, which mounts to the fore boom support 20, and a modified aft support boom 240. In this embodiment, a curved retractable turnfin 250 is rotatably mounted to the arm 242 of the modified aft support boom 240. The rotational movement of the curved retractable turnfin 250 and its mounting portion 252 about the arm 242 is controlled by a turnfin control arm 260 connected to a turnfin control arm link 254. Movement of the turnfin control arm 260, such as by a connected inboard servo within hull 10, causes the mounting portion 252 to rotate about the arm 242, thereby retracting or extending the turnfin 250 to a desired position relative to the sponson 50. Although shown in use for a front starboard sponson 50, it is to be understood that one or more turnfins 250 can be provided on any or all sponsons and/or hulls.

In another embodiment, hulls are provided having integrated suspension systems, and are useful independent of, or in combination with, the sponson suspension systems previously described herein. For example, an embodiment incorporating a hull and sponson combination suspension is shown in FIG. 7. This figure depicts a boat with a main hull 270, two front sponsons 300, 310, and a single rear sponson 330. The port and starboard sponsons 300, 310 are attached to the hull 270 by support booms 280, 290. The front sponsons can be connected by any of the sponson suspension embodiments previously described herein. Alternatively, the booms 280, 290 may be pivotally mounted to the main hull 270 and rigidly attached to the front sponsons 300, 310, such that the booms 280, 290 deflect together with the sponsons 300, 310. At the rear of the hull is a suspended rear sponson 330 mounted to the bottom of a modified hull rear. For example, the rear hull suspension can include trailing arms 320 which allow for movement of a suspended rear sponson 330. These links are preferably attached to suitable loadable structures within the cavity of the hull 270. Preferably the trailing arms are of unequal length, which allows for changes in angle of attack as the rear sponson 330 traverses through its suspension travel. For propulsion, the propeller 340 is preferably attached at the tail of the rear sponson 330, which sponson 330 remains in the water at nearly all times due to its suspension.

Figure 8:
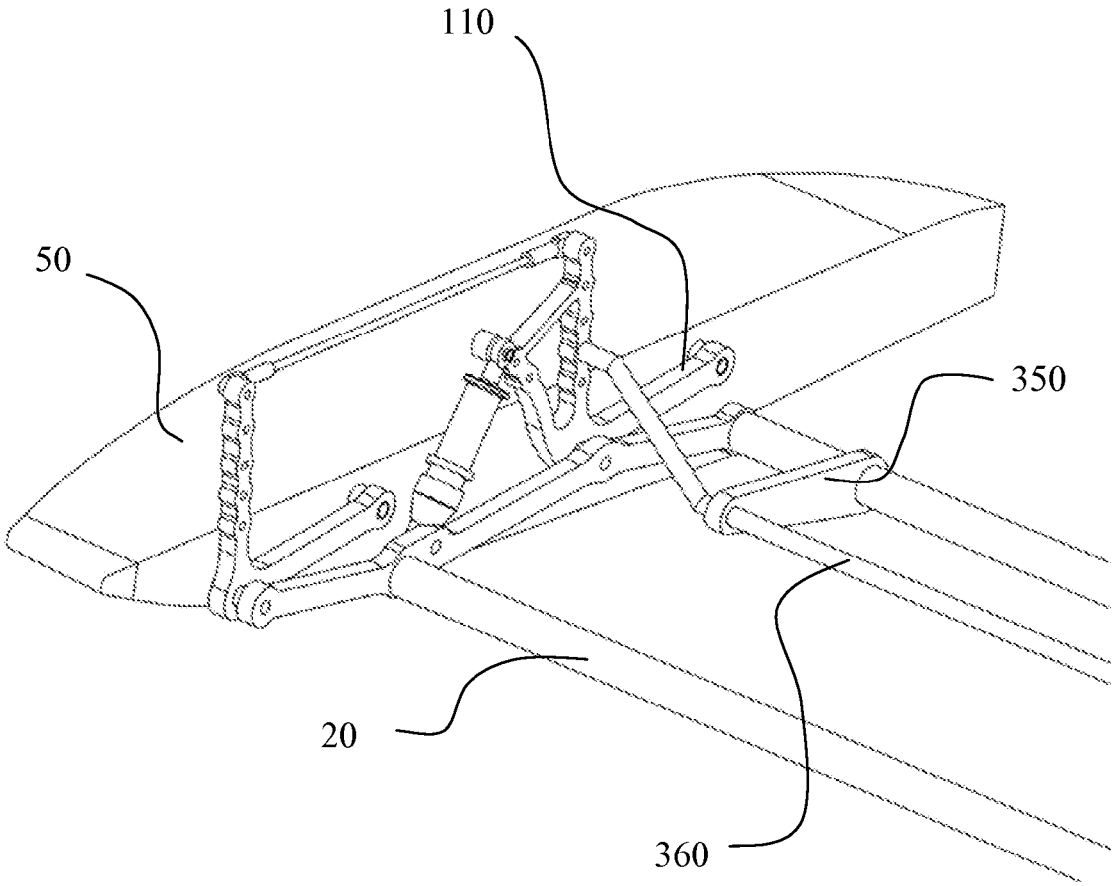
FIG. 8 is an isometric view of the starboard sponson showing front suspension linked with anti roll bar.

FIG. 8 illustrates an embodiment of an anti-pitch and anti-roll feature. As shown, the previously described suspension is attached to the hull 10 through the fore support boom 20 and the aft support boom. The suspension motion of the port and starboard sponsons are coupled via an anti-roll device, such as a link, bar, spring or other arrangement. In the embodiment shown in FIG. 8, an elastic anti-roll bar 360 is used. It is attached to the rear rocker arms (one on each side) and supported by bearings in the supports 350. By attaching the anti roll bar 360 to the port and starboard aft rocker arms 110, the motion of the port and starboard sponsons 40, 50 is elastically linked. When both sponsons enter a bump suspension condition, the front suspension anti-roll bar 360 does not affect the travel. However, during cornering the hull 10 has a tendency to lean away (roll) from the turn. During roll one sponson moves upwards whereas the opposite sponson moves downwards (vertically) relative to the hull. The anti-roll bar 360 reduces this roll by elastically linking the suspension travel of the sponsons through the stiffness of the anti-roll bar.

In another embodiment, anti-pitch coupling may be achieved in a similar fashion by linking the suspension travel of, say, the starboard front sponson to the suspension motion of the starboard rear sponson.

Suspension Layout 1 (2D Front View):

As shown in FIG. 9, sponsons 40, 50 are attached to the main hull 10 via upper 140 and lower 150 wishbone links that have pivoting joints 410 at each end. There is a spring and/or damping unit 100 mounted outboard of the main hull 10 in such a way that its length varies (operating the spring and/or damping unit) as the sponson moves vertically up and down relative to the main hull 10.

Suspension Layout 2 (2D Front View):

As shown in FIG. 10, similar to the Layout 1 in FIG. 10, with the exception being the inboard location of the spring and/or damping unit 100. Motion of the sponson is transferred to the spring and/or damping unit 100 via a link 154 attached at one end near the lower wishbone-to-sponson connection and the other end is attached to a bell crank 156 that pivots about an attachment point on the main hull. The bell crank 156 is also attached to one end of the spring and/or damping unit 100.

Figure 11:
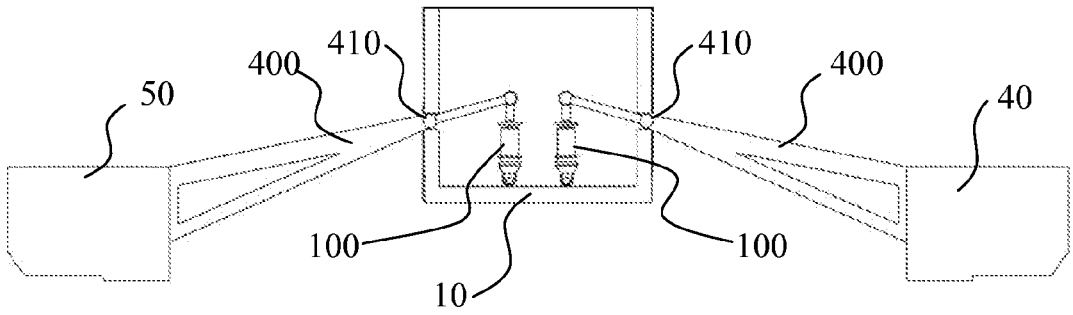
FIG. 11 is a schematic view of a boat suspension in another embodiment.

Suspension Layout 3 (2D Front View):

As shown in FIG. 11, this suspension comprises of a sponson (40 or 50) rigidly mounted to a connecting link 400 that attaches to the main hull 10 via a pivot point 410. This connecting link 400 passes into the main hull 10 where it is attached to a spring and/or damping unit (100). Vertical motion of the sponson relative to the main hull results in motion of the spring and/or damping unit. This spring and/or damping unit could also be located outboard of the main hull, similar to it's location in the Suspension Layout 1 of FIG. 9.

In a different embodiment, shown in FIG. 12, the sponson is attached via two non-parallel trailing arms (rocker arms) 90, 110 to the main hull (or to booms). These trailing arms may or may not be of equal length. In the particular case shown in FIG. 13, when the sponson moves up relative to the hull, the angle of attack (angle between smooth water surface and bottom of sponson, marked in FIG. 12) is reduced. In this embodiment the sponson also moves backwards (rearward) relative to the hull.

As shown and described herein, boats are provided having at least one sponson, at least one hull, connected by a shock absorbing boat suspension. Applying the teachings herein, the inventors provide for selection among any of all of the following additional desirable features: Sponsons may be such that they can be raised and lowered for beaching of the craft as well as loading or un-loading of cargo and/or passengers.

Further, the number of sponsons can vary from one to many and can be added or subtracted on the same craft based on cargo requirements. Sponsons can be fuel or cargo carrying. Sponsons may be sprung, damped, and any combination thereof. Propulsion can be mounted to the main hull, and/or to one or more sponsons, and/or any combination of both the main hull and the sponsons. Motion of the sponsons may be coupled via provisions of, for example, anti roll and/or anti pitch devices.

Figure 13:
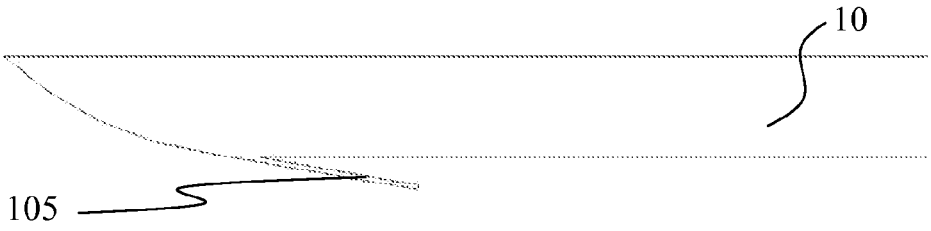
FIG. 13 is a schematic view of a boat suspension in another embodiment.

The sprung and unsprung mass of the boat, hull and suspension is preferably selected such that the sponson's motion can be effectively controlled relative to the motion of the water. Pitch, roll, yaw as well as vertical and horizontal translations of the sponsons can be selectively varied by selection of suspension elements and mounting types such that sponson motion varies through its range of motion to provide desired stability etc of the boat. Track width and position relative to the main hull of the sponsons can vary left to right and front to back per application. Fin(s) and/or rudder(s) can be located on any or all of the sponsons as well as the main hull. Additionally, as shown in FIG. 13, in another example, a shock absorbing member may consist simply of a running surface in the form of a flexible flexure 105 attached to the bottom of a sponson 40,50 or hull 10 and shaped to protrude into the water below the hull. A damper may be attached to the flexure.

Suspension shock absorbing members such as springs and dampers can be located inboard or outboard of the main hull. Links connecting the sponsons to the main hull can be fixed or articulatable, and can articulate at one or more locations.

Sponsons can have any type of running surface, planning, semi-planing, hydrofoil, and/or displacement type. Center hulls can be designed to operate with the sponsons retracted out of the water. Ride height of the center hull can be varied while in operation if desired.

Importantly, the inventors have discovered that aerodynamic enhancements to the hull and sponsons are not a primary factor in the shock absorbing function of the boat, even at high speeds. Indeed, no aerodynamic improvements were necessary for scaled boats embodying the boat suspensions herein to reach scaled speeds of over 75 mph. Buoyancy of the sponsons may be varied, and need not be high enough to lift the main hull out of the water at rest or low speeds. Preferably, the boat suspensions herein utilize passive suspension systems, and therefore do not need to rely on computer control to operate properly.

While this description is made with reference to exemplary embodiments, it will be understood by those skilled in the art that various changes may be made and equivalents may be substituted for elements thereof without departing from the scope. In addition, many modifications may be made to adapt a particular situation or material to the teachings hereof without departing from the essential scope. Also, in the drawings and the description, there have been disclosed exemplary embodiments and, although specific terms may have been employed, they are unless otherwise stated used in a generic and descriptive sense only and not for purposes of limitation, the scope of the claims therefore not being so limited. Moreover, one skilled in the art will appreciate that certain steps of the methods discussed herein may be sequenced in alternative order or steps may be combined. Therefore, it is intended that the appended claims not be limited to the particular embodiment disclosed herein.

The invention claimed is:

1. A boat comprising at least one hull, and at least one sponson, the at least one hull and at least one sponson connected by at least one shock absorbing boat suspension, wherein the shock absorbing suspension reduces hull acceleration such that the hull accelerations are generally substantially less than accelerations of at least one sponson at selected speeds, and wherein the shock absorbing boat suspension is not part of a hydrofoil control system.

2. The boat of claim 1, wherein at least one shock absorbing boat suspension comprises at least one spring.

3. The boat of claim 1, wherein at least one shock absorbing boat suspension comprises at least one damper.

4. The boat of claim 1, wherein the shock absorbing suspension is connected to the at least one hull and the at least one sponson by mounting means that are selected from the group consisting of flexible means, rigid means, fixed means, pivotal means, rotational means, or any combination thereof.

5. The boat of claim 4, wherein a turn fin is provided on at least one sponson.

6. The boat of claim 4, wherein the shock absorbing suspension further comprises at least one of an anti-roll device, anti-pitch device, or combinations thereof.

7. The boat of claim 4, wherein the shock absorbing suspension comprises a trailing arm suspension.

8. The boat of claim 4, wherein the mounting means comprises at least one boom or at least one wishbone.

9. The boat of claim 8, wherein the at least one boom or at least one wishbone is mounted to the hull at a location selected from the group consisting of starboard, port, fore, aft, and combinations thereof.

10. The boat of claim 9, wherein the at least one boom comprises at least 2 booms.

11. The boat of claim 10, wherein only one sponson is connected to each of the at least two booms by the suspension.

12. The boat of claim 1, wherein the at least one sponson comprises at least two sponsons positioned in at least one of fore, port, and starboard of the at least one hull.

13. The boat of claim 12, wherein the boat further comprises an additional shock absorbing suspension located aft of the hull.

14. The boat of claim 1, wherein the shock absorbing suspension comprises a full front suspension and a full rear suspension.

15. The boat of claim 1, wherein the at least one hull consists of a main hull, and wherein the main hull is connected to the shock absorbing suspension by at least a fore support boom and an aft support boom.

16. The boat of claim 8, wherein each of the booms comprise a first end that is fixedly attached to the hull.

17. The boat of claim 16, wherein each boom comprises an opposite protruding end that is fixedly attached to the shock absorbing suspension.

18. The boat of claim 17, wherein the shock absorbing suspension includes at least two rocker arms, and wherein at least one of the rocker arms is connected to a damper or a spring.

19. A boat comprising at least one hull, and at least one sponson, the at least one hull and at least one sponson connected by at least one shock absorbing boat suspension, wherein the shock absorbing suspension is connected to the at least one hull and the at least one sponson by mounting means that are selected from the group consisting of flexible means, rigid means, fixed means, pivotal means, rotational means, or any combination thereof, wherein the mounting means comprises at least one boom or at least one wishbone, wherein each of the booms comprise a first end that is fixedly attached to the hull, wherein each boom comprises an opposite protruding end that is fixedly attached to the shock absorbing suspension, wherein the shock absorbing suspension includes at least two rocker arms, wherein at least one of the rocker arms is connected to a damper or a spring, and wherein the rocker arms comprise at least one fore rocker arm and at least one aft rocker arm, each rocker arm rotatably mounted to a fixed suspension member, the fixed suspension member attached to at least one boom.

20. The boat of claim 19, wherein each rocker arm is further rotatably mounted to at least one sponson.

* * * * *